US006390319B1

(12) United States Patent
Yu

(10) Patent No.: US 6,390,319 B1
(45) Date of Patent: May 21, 2002

(54) BEVERAGE MAGNETIZING CONTAINER

(76) Inventor: Sun Yu, 2850 Coolidge, Berkley, MI (US) 48072

( * ) Notice: Subject to any disclaimer, the term of this patent is extended or adjusted under 35 U.S.C. 154(b) by 0 days.

(21) Appl. No.: 09/450,600

(22) Filed: Nov. 30, 1999

Related U.S. Application Data

(60) Provisional application No. 60/110,242, filed on Nov. 30, 1998.

(51) Int. Cl.[7] ..... B65D 1/04; B65D 1/06; B65D 51/00

(52) U.S. Cl. ..... 220/230; 215/6; 220/504; 220/521; 220/528

(58) Field of Search ..... 215/6; 220/230, 220/212, 528, 521, 522, 503, 504, 506

(56) References Cited

U.S. PATENT DOCUMENTS

| | | | | | |
|---|---|---|---|---|---|
| 655,413 | A | | 8/1900 | Parkyn | |
| 2,524,972 | A | | 10/1950 | Hamilton | |
| 2,672,257 | A | * | 3/1954 | Simmonds | 220/320 |
| 3,610,459 | A | * | 10/1971 | Hanson | 220/23.83 |
| 3,805,995 | A | * | 4/1974 | Lebel et al. | 220/603 |
| 4,468,321 | A | * | 8/1984 | St. John | 210/232 |
| 4,489,842 | A | * | 12/1984 | Bobrove | 215/213 |
| 4,510,665 | A | * | 4/1985 | Scheurer | 215/395 |
| 4,793,476 | A | * | 12/1988 | Schrupp | 206/222 |
| 4,904,381 | A | | 2/1990 | Urakami | |
| 5,009,791 | A | | 4/1991 | Lin et al. | |
| 5,055,189 | A | | 10/1991 | Ito | |
| 5,244,106 | A | * | 9/1993 | Takacs | 215/12.1 |
| 5,288,401 | A | | 2/1994 | Rodriguez | |
| 5,299,433 | A | | 4/1994 | Harms et al. | |
| 5,500,121 | A | | 3/1996 | Thornton et al. | |
| 5,534,156 | A | | 7/1996 | Sanderson | |
| 5,556,654 | A | * | 9/1996 | Fregeau | 426/234 |
| 5,584,994 | A | | 12/1996 | Hattori et al. | |
| 5,769,680 | A | * | 6/1998 | Hoffman | 215/6 |
| 5,803,316 | A | | 9/1998 | Couture | |
| 5,804,068 | A | * | 9/1998 | Reed | 210/222 |
| 6,036,061 | A | * | 3/2000 | O'Donnell | 215/276 |

FOREIGN PATENT DOCUMENTS

| | | | |
|---|---|---|---|
| GB | 2240960 | A * | 8/1991 |

* cited by examiner

*Primary Examiner*—Lee Young
*Assistant Examiner*—Niki M. Eloshway
(74) *Attorney, Agent, or Firm*—Gifford, Krass, Groh, Sprinkle, Anderson & Citkowski, P.C.

(57) ABSTRACT

A beverage container volume is exposed to magnetic fields associated with a permanent magnet. A beverage container volume is exposed to a permanent magnet incorporated into a beverage container cap, bottom, collar, holder or overlayer.

6 Claims, 2 Drawing Sheets

FIG-1
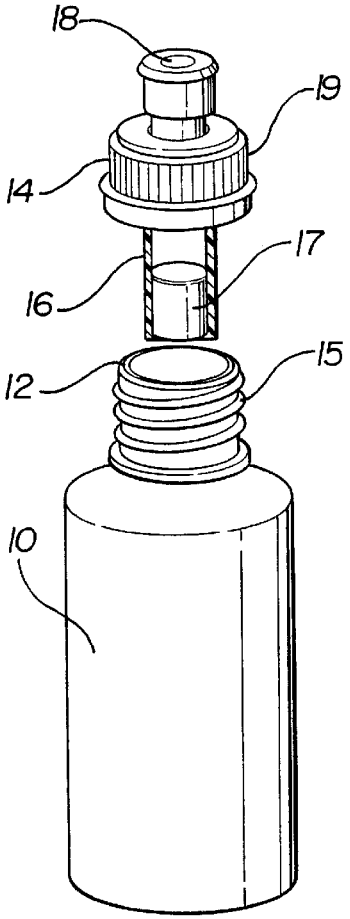
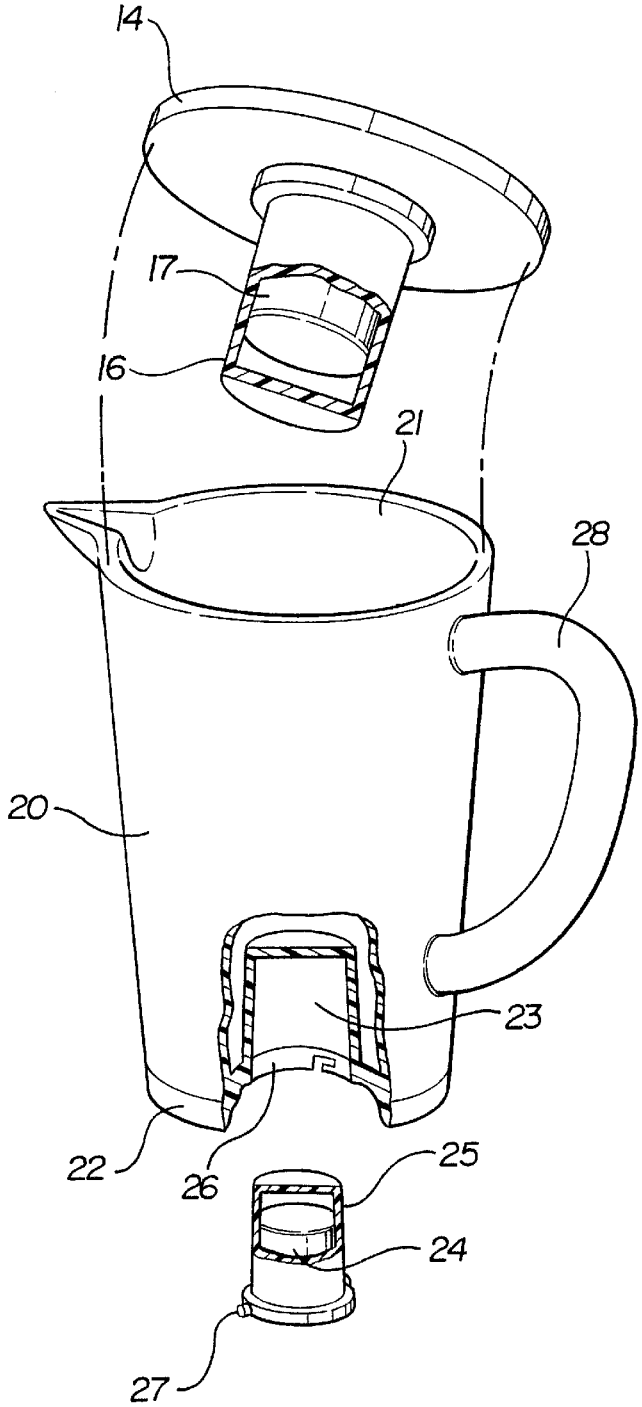
FIG-2

BEVERAGE MAGNETIZING CONTAINER

RELATED APPLICATIONS

This application claims priority of U.S. provisional application 60/110,242, filed Nov. 30, 1998, which is incorporated herein by reference.

FIELD OF THE INVENTION

The present invention relates to beverage containers, and in particular to devices for exposing the contents thereof to magnetic fields.

BACKGROUND OF THE INVENTION

It is well established that exposing beverages to a magnetic field promotes preservation. In particular, the storage of wine in the presence of a magnet is known to promote proper wine aging thereby improving the quality of the wine. This is typically accomplished by placing a wine bottle within the bore of a magnet or by inserting a polymer or glass coated permanent magnet into the bottle after uncorking.

A magnet has previously been incorporated into a beverage storage pitcher and a drinking mug. Previous use of magnets has focused on keeping a pitcher element such as a cooler in place. U.S. Pat. No. 5,299,433 is an example of such an application of a magnet. Magnets have also been incorporated into drinking vessels to promote magnetic therapy within the grasping hand of a consumer. Recently, healthful effects have been noted upon the consumption of magnetized beverages.

As faith in the integrity of domestic water supplies decreases, consumers are turning to purified and bottled water sources in ever increasing numbers. To date, consumers of prepackaged beverages cannot conveniently utilize the preservative and purifying value of consuming magnetized beverages. Thus, there exists a need for a beverage container capable of exposing a beverage volume to the therapeutic effects of a magnet.

BRIEF DESCRIPTION OF THE DRAWINGS

FIG. 1 is a perspective view of a container of the present invention having a cap including a hollow appendage containing a magnet;

FIG. 2 is a perspective partial cutaway view of a container of the present invention wherein the container bottom forms an external cavity into which a magnet is inserted;

SUMMARY OF THE INVENTION

Figure 4:
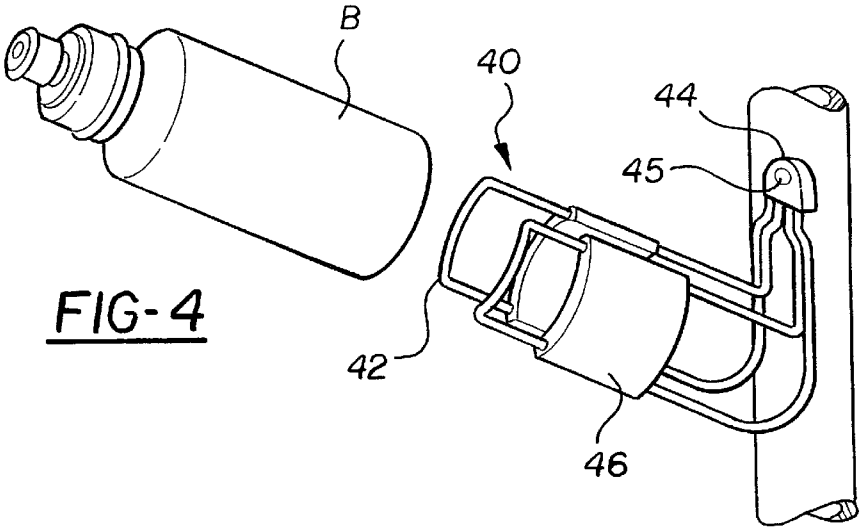
FIG. 4 is a perspective view of a beverage container holder having a magnet incorporated thereto.

A beverage container of the present invention includes a vessel having sidewalls terminating in a mouth thereby defining a volume. A cap having a hollow appendage designed to fit through the mouth, containing a permanent magnet and the cap selectively sealing to the mouth.

Another beverage container of the present invention has sidewalls and a bottom, wherein the bottom is fashioned to form a cavity designed to include a permanent magnet. A conventional beverage container is exposed to the benefits of the present invention through insertion into a molded beverage container overlayer article including at least one permanent magnet therein.

A beverage container holder is fixtured to a substrate such as a bicycle frame including a frame adapted to receive a beverage container and at least one permanent magnet. The magnetic flux from the magnet impinges upon the beverage container volume.

Alternatively, a ring-shaped magnet is coated with a polymeric material. The inner surface of the ring-shaped magnet is adapted to engage a beverage container.

DETAILED DESCRIPTION OF THE INVENTION

The present invention in all its embodiments is related to exposing a beverage to a magnetic field associated with a permanent magnet. Beverages are packaged at a point of origin with an encapsulated magnet incorporated into a beverage container. Alternatively, a beverage is stored and/or consumed from a container exposed to the magnetic fields of a proximate magnet. Storage and/or consumption devices of the present invention exposing the enclosed beverage volume to a magnetic field include a bottle, pitcher, insulating overlayer, container holder and a collar. The beverage container materials being chosen to be permissive to magnetic flux.

A permanent magnet as defined herein includes plastilloy materials, ceramics and metallics having a permanent magnetic dipole.

In reference to FIG. 1, a vessel 10 defines an internal volume V in which a beverage is contained. The vessel 10 has a mouth 12. A cap 14, is selectively sealable against the mouth 12. Sealing includes forming an interface between the mouth 12 and a complementary surface of the cap 14. In the embodiment depicted in FIG. 1, the force necessary to retain the cap 14 in contact with the mouth 12 is provided by engaging threads 15 of the vessel 10 with complementary threads (not shown) within the cap assembly 14. It is appreciated that there are a variety of conventional methods for forming a seal between a vessel mouth and a cap, any number of which are operative herein. Further, it is appreciated that a cap adapted to insert within the mouth, as well as encompass the mouth, is operative herein.

The cap assembly 14 further includes a hollow appendage 16. The appendage 16 has dimensions allowing the appendage 16 to insert through the mouth 12 of the vessel 10. The appendage 16 encloses a permanent magnet 17 therein. The appendage is fused or otherwise adhered to the cap body 14 so as to isolate the magnet 17 from the vessel volume V. Preferably, the cap body 14 and the appendage 16 are composed of a polymeric or vitreous material. More preferably, the cap body and appendage are composed of injection moldable thermoplastic material. The magnet 17 is composed of any number of conventional ferromagnetic materials. Optionally, the cap body 14 includes a spout 18 which is selectively openable at the consumer's discretion and independent of the seal created between the mouth 12 and the cap body 14. Spout 18 is selectively openable by exerting mechanical forces thereon. It is appreciated that a spout can also be configured as a hinged closure or fashioned into a conventional pump or spray handle. In the embodiment shown in FIG. 1, there exists a beverage passage 19 allowing beverage communication between the volume V and the spout 18 by way of the cap body 14.

FIG. 2 shows a perspective partial cutaway view of an embodiment of the present invention including a magnet inserted into a container bottom. A vessel 20 has sidewalls 21 and a bottom 22 configured to define a volume in which a beverage is contained. The bottom 22 is contoured to form a cavity 23 external to the volume V. A magnet 24 is adapted to insert within the cavity 23. The magnet 24 is held to the bottom 22 of the vessel 20 by a conventional mechanical fixture or attractive magnetic forces between a portion of the magnet 24 and an attractively oriented magnet affixed to the vessel 20 in proximity to the cavity 23. Optionally, a handle 28 is affixed to the sidewalls 21. Preferably, the magnet 24 is encased within a plastic plug 25 and the mounting system for coupling the magnet 24 within the cavity 23 is fixtured to the plug 25. More preferably, magnet 24 is coupled to the cavity 23 by mechanical means. An illustrative means for coupling the magnet 24 to the cavity 23 shown in FIG. 2 includes a slotted flange 26 terminal to the cavity 23 in the vicinity of the bottom 22. A complementary key 27 inserts into the slotted flange 26 and upon rotation of the plug 25 within the cavity 23 results in the key being selectively held in place within the cavity 23 by the slotted flange 26. It is appreciated that other mechanical securing systems including threads, adhesives and other conventional closures are operative herein. It is further appreciated that while the vessel 20 depicted in FIG. 2 is configured as a pitcher, the present invention as depicted in this embodiment is also operative in instances where a vessel is configured as a bottle.

Figure 3:
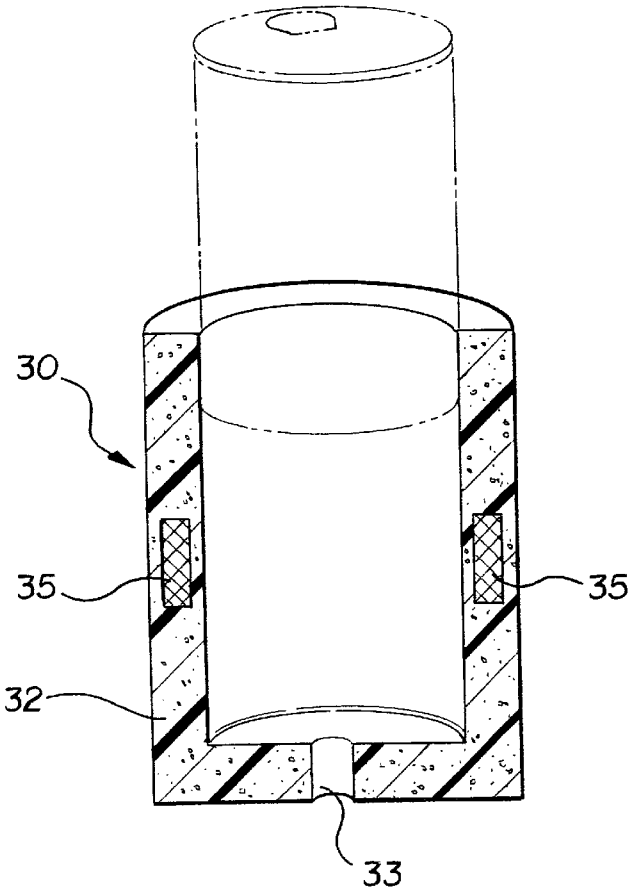
FIG. 3 is a cutaway of a beverage overlayer for insulating a beverage container and having a magnet affixed thereto.

FIG. 3 is a cutaway of an insulating beverage overlayer of the present invention, generally shown at 30. The insulating beverage overlayer 30 is composed of a blown polymeric foam 32 configured as a cylinder which is adapted to receive a single serving beverage container such as a conventional can or bottle. The polymeric foam illustratively including polyurethane, polyalkenes, neoprene, polyurea, polystyrene, polyamides, and polyisocyanates. Foam cylinder 32 optionally has a base aperture 33 to facilitate insertion of a beverage container into the insulating beverage overlayer 30. The insulating beverage overlayer 30 also includes at least one permanent magnet 35. The magnet 35 is depicted in FIG. 3 as an axial ring magnet having an inner diameter sufficient to allow insertion of a beverage container therethrough. It is appreciated that a flexible bar magnet or plurality of bar magnets (not shown) are also operative herein. The magnet 35 is preferably encased within the foam cylinder 32. It is appreciated that a groove or other accommodation formed in a foam rubber cylinder will also suitably receive the magnet with the knowledge that the effective magnetic field decreases with distance therefrom.

FIG. 4 is a perspective view of a beverage container holder of the present invention. A holder generally shown at 40 includes a tubular member 42 formed to receive a beverage container B of a preselected dimension. The tubular member 42 is constructed of a bendable metal rod or an injection moldable thermoplastic material. The holder 40 also includes a fixturing aperture 44 and a fixturing fastener 45 in order to secure the holder 40 to a substrate S. It is appreciated that an adhesive or mechanical strap are also suitable as means for fixturing the holder 40 to a substrate S. A permanent magnet is included within the holder 40 such that the magnetic fields emanating from the magnet 46 impinge upon a bottle B upon insertion into the holder 40. Preferably, the magnet 46 is a flexible magnet having ferromagnetic particles embedded in an elastically deformable sheet. Optionally, a plurality of magnets aligned to reinforce the magnetic fields of one another are affixed to the holder 40.

Figure 5:
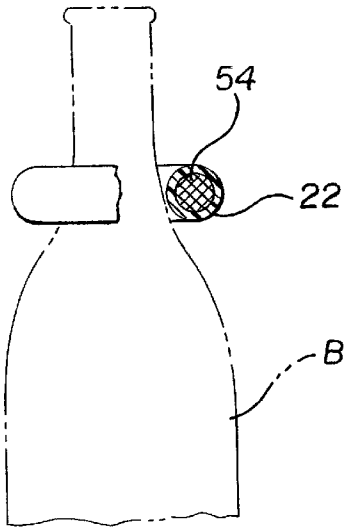
FIG. 5 is a partial cutaway view of a beverage magnetizing collar designed to engage a beverage container.

FIG. 5 depicts a magnetizing collar of the present invention designed to engage a variety of beverage containers. The collar generally shown at 50 includes a cylindrical core magnet 52 formed into a generally circular shape. The magnet 52 is coated with a polymeric coating 54 designed to prevent contact between the magnet 52 and an encompassed bottle B. The internal bore of the collar 50 is sufficiently large to allow the collar 50 to be slipped over the mouth of a conventional bottle and to rest on a tapered portion of a conventional bottle neck. It is appreciated that a ring of less than 360 degrees is operative herein and that a curved structure of greater than approximately 270 degrees is sufficient to engage a conventional bottle B. The collar 50 is placed on a bottle B having a beverage therein such that the magnetic fields generated by the magnet 52 interact with the contents of the bottle B to promote purification and magnetization of the bottle contents. The bottle B, like all the beverage containers discussed herein, is constructed of materials which are traversed by magnetic fields. Thus, the bottle B is illustratively composed of vitreous or polymeric materials.

All patents and references cited herein are incorporated by reference to the same extent as if each was individually and explicitly incorporated.

While certain features and embodiments of the invention have been described herein, it will be understood that the invention encompasses all modifications and enhancements within the scope and spirit of the following claims.

What is claimed is:

1. A beverage container comprising:

a vessel having sidewalls and a bottom, the sidewalls and the bottom defining a volume for a beverage, and an exterior, the bottom being contoured to form a cavity external to the beverage volume, the cavity having a wall;

a magnet compartment, having a wall, the magnet compartment wall disposed in the cavity; and a magnet within the magnet compartment such that the magnet is separated from the beverage volume by the cavity wall and the magnet compartment wall.

2. The container of claim 1 wherein said magnet is encased within a plastic plug adapted to selectively attach to the bottom and insert into the cavity.

3. The container of claim 1 further comprising a cap adapted to selectively seal the volume.

4. The container of claim 3 wherein said cap has a hollow appendage adapted to insert into said vessel, the appendage having a permanent magnet therein.

5. The container of claim 1 wherein said vessel is a pitcher.

6. The container of claim 1 wherein said vessel is a bottle.

* * * * *